US007303354B1

(12) United States Patent
DeCroix

(10) Patent No.: US 7,303,354 B1
(45) Date of Patent: Dec. 4, 2007

(54) TEMPORARY MANHOLE COVER

(76) Inventor: Steven DeCroix, 5986 Mareta La., Loomis, CA (US) 95650

( * ) Notice: Subject to any disclaimer, the term of this patent is extended or adjusted under 35 U.S.C. 154(b) by 0 days.

(21) Appl. No.: 11/526,888

(22) Filed: Sep. 21, 2006

(51) Int. Cl.
*E02D 29/14* (2006.01)

(52) U.S. Cl. ..... 404/25; 52/19

(58) Field of Classification Search ..... 404/25, 404/26; 52/19, 20
See application file for complete search history.

(56) References Cited

U.S. PATENT DOCUMENTS 3,046,853 A * 7/1962 Legendre ..... 404/25
3,236,055 A * 2/1966 Tokola ..... 405/228
3,621,623 A * 11/1971 Downes ..... 404/25
4,109,425 A * 8/1978 Carlessimo ..... 52/21
4,655,913 A 4/1987 Boersma
4,762,440 A * 8/1988 Argandona ..... 405/52
4,995,757 A * 2/1991 Prescott ..... 404/26
5,123,776 A * 6/1992 Lang et al. ..... 404/25
5,130,016 A * 7/1992 Gavin ..... 210/164
5,529,431 A 6/1996 Walsh
5,979,117 A * 11/1999 Fuller ..... 52/19
5,987,824 A * 11/1999 Fuller ..... 52/19
6,893,186 B1 5/2005 Tello, Sr.

FOREIGN PATENT DOCUMENTS

JP 2003105789 A 4/2003

* cited by examiner

*Primary Examiner*—Raymond W. Addie
(74) *Attorney, Agent, or Firm*—Patel & Alumit, PC.; Edwin Tarver; Tj Ung

(57) ABSTRACT

A temporary cover for manholes to provide a platform for maintenance workers when operating valves of underground utility systems. The cover comprising a circular outer rim dimensioned to fit into a manhole opening, a pair of parallel and spaced apart rods extending from the outer rim to its center, a valve key receiving and positioning assembly movable along the rods, and a meshed framework covering an area bordered by the circular rim, leaving an area between the two rods. The assembly comprises a ring and two diametrically opposite sleeves exteriorly attached to the ring for receiving the rods. A valve key can be inserted into the manhole through the ring. The meshed framework serves as a platform to support a person and defines a plurality of openings facilitating viewing into the manhole after the cover is placed thereon.

12 Claims, 3 Drawing Sheets

TEMPORARY MANHOLE COVER

CROSS-REFERENCE TO RELATED APPLICATION

None

FEDERALLY SPONSORED RESEARCH

Not Applicable

SEQUENCE LISTING OR PROGRAM

Not Applicable

STATEMENT REGARDING COPYRIGHTED MATERIAL

Portions of the disclosure of this patent document contain material that is subject to copyright protection. The copyright owner has no objection to the facsimile reproduction by anyone of the patent document or the patent disclosure as it appears in the Patent and Trademark Office file or records, but otherwise reserves all copyright rights whatsoever.

BACKGROUND

The present invention relates in general to manhole covers, and more particularly to a temporary manhole cover to be used while performing maintenance activities.

Manholes provide access to underground systems such as water and sewer utilities. Typically, they are covered with metal covers designed to withstand heavy weight loads, such as those from vehicles. The manhole cover is removed using a tool to gain access to the manhole. Typically, uncovered manholes are cordoned off during maintenance to avoid accidents. Temporary manhole covers are occasionally used to cover the manholes during maintenance to increase safety.

Several temporary manhole covers have been developed in art. For example, U.S. Pat. No. 6,893,186 to Tello discloses a temporary manhole cover for protecting workers purging a sewer line from splattering waste. The cover includes a substantially circular outer rim peripherally bordering a central indented portion and a pair of diametrically opposed handles positioned on the outer rim. The indented portion is preferably transparent to allow a worker to see into the manhole. An elongated opening extends from the center of the indented portion to the outer edge of the rim. A plurality of contiguous and intermeshing bristles are horizontally disposed within the opening. A water hose may be inserted through the bristles. The bristles prevent waste from exiting the manhole and assist in retaining the water hose at a desired position. The purpose and associated structures involved in viewing into the manhole and protecting workers from splattering waste of this cover are different from the present invention.

U.S. Pat. No. 5,529,431 to Walsh discloses a temporary manhole cover constructed of glass fiber reinforced polymeric plastic. The cover is an integral unit comprising a circular disc shape, an outer circular edge having a thickness, and a multiplicity of openings through a thickness of the disc shape spaced apart across the entire shape. The manhole cover also includes a cut out to the edge for pipes, tubing, and wires to be trained through the opening down the manhole. The manhole cover is strong enough to support a motor vehicle and light enough to be lifted out from below or above. Although the openings are similar, the present invention differs in that it comprises a different utility adapted for receiving maintenance tools.

Intl. App. No. JP2003105789 to Ishigaki discloses a temporary manhole cover having a disc-like cover body for blocking up an opening of the manhole disposed in the underground pipeline. The cover is provided with a penetrating hole to pass a blower pipe for feeding air into the underground pipeline, a plurality of light incident holes extending over the whole surface to make external light enter the underground pipeline, and an insert hole to handle the cover by inserting the hand. The disc-like structure and the configuration of the holes of this cover differ from the present invention.

Generally, valves of underground water utilities or other systems are accessed through the manholes, and maintenance workers have to climb down to operate them. A valve key tool, principally comprising an elongated rod, helps maintenance workers to operate the valves from the ground surface after opening the manhole cover. However, using the valve key from above an open manhole is hazardous for the workers in that there is a risk of falling into the manhole.

Therefore, it is an object of the present invention to provide a temporary manhole cover for use during operating valves of underground utilities.

A further object is to provide a temporary manhole cover that facilitates viewing into a manhole after installed thereon.

Finally, it is an object of the present invention to provide a temporary manhole cover that includes an adjustable mechanism for receiving and positioning a valve key. These and other objects of the present invention will become better understood with reference to the appended Summary, Description, and Claims.

SUMMARY

The present invention is a temporary manhole cover designed to provide safety for maintenance workers while operating valves in underground utility systems using valve keys. The cover comprises a circular outer rim, two parallel and spaced apart rods extending from the outer rim to its center, an assembly for receiving a valve key, and a meshed frame platform covering the inner area of the circular ring, except for the area between the rods. The assembly for receiving a valve key comprises a ring and two sleeves attached diametrically opposite the ring. Each rod is received in a sleeve such that the assembly can slide along the rods. The ring is adapted to receive conventional valve keys. The meshed frame platform defines a plurality of openings that facilitate viewing into the manhole after the cover is installed. The cover also includes a pair of handles to install and remove it.

Depending on the location of the valves, the temporary manhole cover can be oriented over a manhole and the valve key is inserted into the manhole through the ring. The valve key can then be moved along the rods to reach and operate the valves.

FIGURES

Reference Numerals

10 . . . Temporary Manhole Cover
11 . . . Outer Rim
12 . . . Rod
13 . . . Sliding Assembly
14 . . . Meshed Framework
15 . . . Ring
16 . . . Sleeve
17 . . . Opening
18 . . . First Bar
19 . . . Second Bar
20 . . . Third Bar
21 . . . Fourth Bar
22 . . . Handle
23 . . . Stop Member
24 . . . User
25 . . . Valve Key

DETAILED DESCRIPTION

Figure 1:
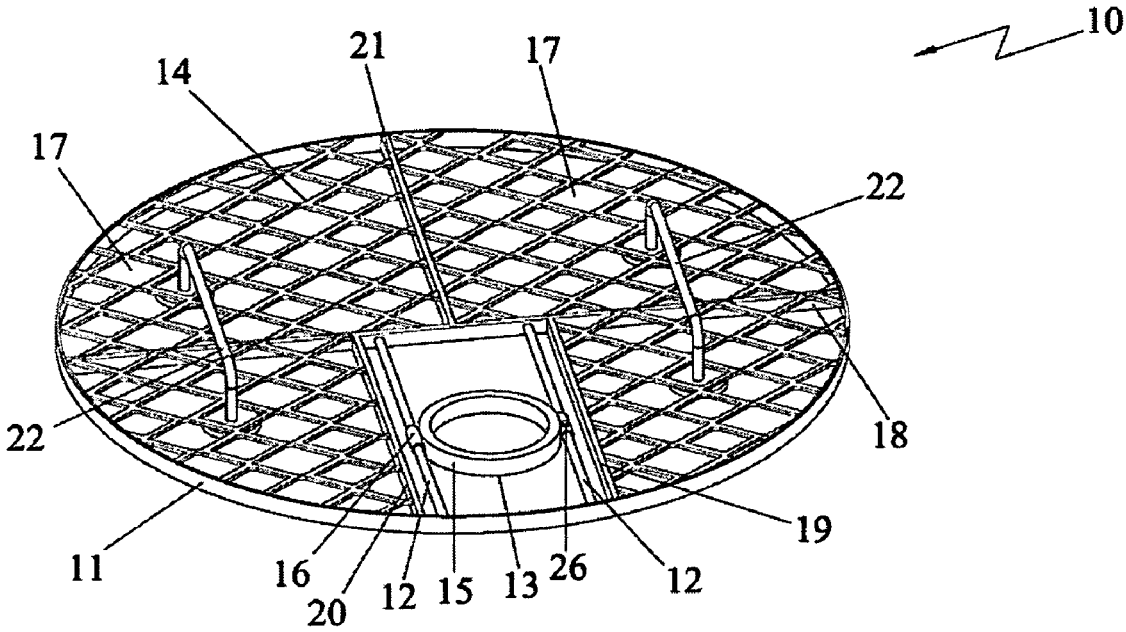
FIG. 1 is a top perspective view of the temporary manhole cover of the present invention.
Figure 2:
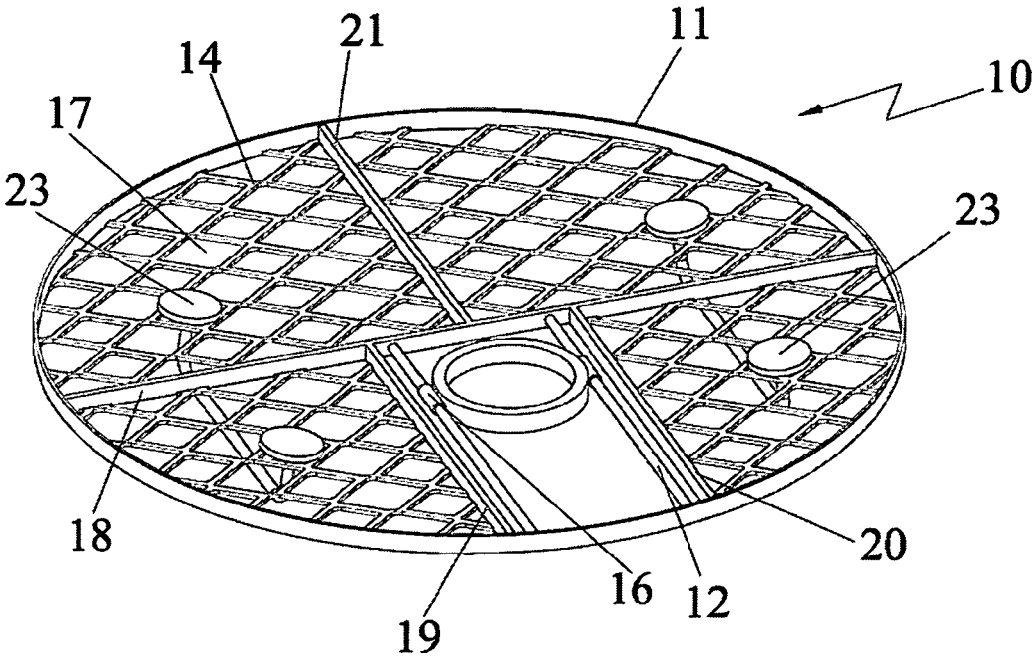
FIG. 2 is a bottom perspective view of the temporary manhole cover of the present invention.
Figure 3:
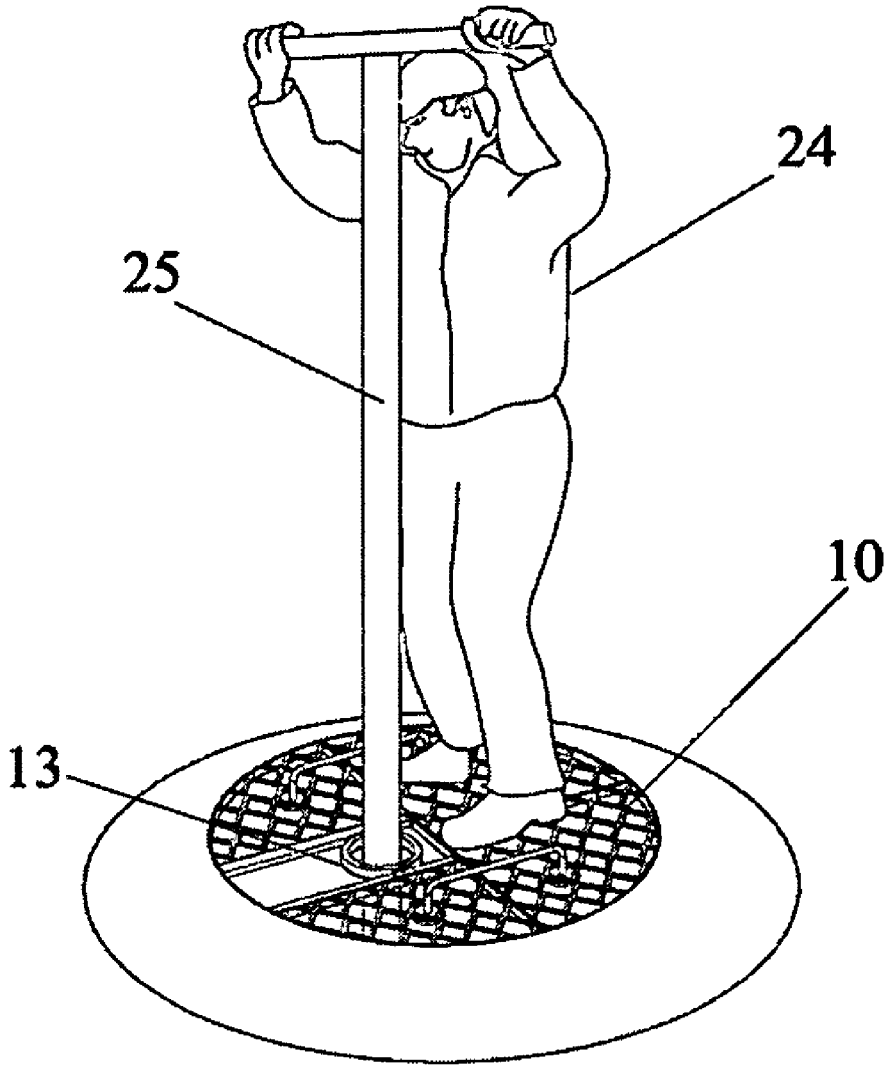
FIG. 3 is an illustration showing the temporary manhole being operated by a user.

Referring to the drawings, a preferred embodiment of the temporary manhole cover is illustrated and generally indicated as 10 in FIGS. 1 through 3. The cover 10 mainly comprises a circular outer rim 11, two parallel and spaced apart rods 12, a sliding assembly 13 for receiving and positioning a valve key, and a meshed framework 14.

Referring to FIGS. 1 and 2, the rods 12 extend from the outer rim 11 to its center. The outer rim 11 is dimensioned to fit in a manhole. The sliding assembly 13 comprises a ring 15 and two sleeves 16 attached to the ring. The sleeves 16 are diametrically opposite and oriented to receive the rods 12 in a manner that the sliding assembly 13 is movable along the rods. The framework 14 defines a plurality of openings 17 for seeing through the cover 10.

The cover 10 further comprises three bars, namely, a first 18, second 19, third 20, and fourth 21. The first bar 18 is along the diameter of the outer rim 11. The second and third bars 19 and 20 are parallel and adjacent the rods 12. The fourth bar 21 extends perpendicularly from the center of the first bar 18 to the outer rim 11. The meshed framework 14 covers an area bordered by the second and third bars 19 and 20 and a portion of the outer rim 11. The framework 14 serves as a platform to support a maintenance worker. The first and fourth bars 18 and 21 provide additional strength to the framework.

The cover further includes a pair of diametrically opposite handles 22 near each end of the first bar. Each handle 22 comprises a U-shape with its free ends passing from the top side of the cover to the bottom side through a pair of the openings in the meshed platform. A stop member 23 is attached on each of the free ends to prevent the handle from slipping back though the openings.

Referring to FIG. 3, in order to perform maintenance activities on underground utility systems, the temporary manhole cover 10 is placed over the manhole in place of a conventional manhole cover. A user 24 then stands on the framework to view into the manhole through the openings 17 to locate the valves. The orientation of the cover 10 is adjusted based on the location of the valves. A valve key 25 is then inserted through the ring 15. The valve key 25, along with the sliding assembly 13, is moved along the rods 12 to reach and operate the valves.

In an alternate embodiment (not shown), the temporary manhole cover comprises a rectangular or other polygonal shape. In this case, the cover is designed to be placed over the surface of the manhole rather than fitting into the manhole as with the cover 10 of the previous embodiment. Except for the change in shape of the outer rim, which is now rectangular (or polygonal), the configurations of the rods, the sliding assembly, and the meshed framework remain the same in the alternate embodiment.

All features disclosed in this specification, including any accompanying claims, abstract, and drawings, may be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means for" performing a specified function, or "step for" performing a specific function, is not to be interpreted as a "means" or "step" clause as specified in 35 U.S.C. § 112, paragraph 6. In particular, the use of "step of" in the claims herein is not intended to invoke the provisions of 35 U.S.C. § 112, paragraph 6.

Although preferred embodiments of the present invention have been shown and described, various modifications and substitutions may be made thereto without departing from the spirit and scope of the invention. Accordingly, it is to be understood that the present invention has been described by way of illustration and not limitation.

What is claimed is:

1. A temporary manhole cover comprising:

a. an outer rim dimensioned to fit into a manhole opening;

b. a pair of parallel and spaced apart rods extending from the outer rim to the center such that the center is midway between the rods;

c. a valve key receiving and positioning assembly comprising a substantially circular ring and two diametrically opposite sleeves exteriorly attached to the ring for receiving the rods, wherein the assembly is movable along the rods and a valve key can be inserted into the manhole through the ring; and d. a meshed framework covering an area bordered by the circular rim, leaving an area between the two rods, the meshed framework serving as a platform to support a user and defining a plurality of openings that facilitate sight through the manhole cover for viewing into the manhole after the cover is placed thereon.

2. The temporary manhole cover of claim 1, wherein the cover further comprises a first bar disposed along a diameter of the outer rim and a second and a third bar adjacent the pair of the rods, wherein the rods, the second bar, and the third bar extend from the outer rim to the first bar.

3. The temporary manhole cover of claim 2, wherein the cover comprises a fourth bar extending perpendicularly from the center of first bar, away from the rods, to the outer rim, wherein the first and fourth bars provide additional strength to the meshed frame platform.

4. The temporary manhole cover of claim 2, wherein the meshed framework covers an area bordered by the second bar, the third bar, a portion of the outer rim, and a portion of the first bar that is between the second and third bar.

5. The temporary manhole cover of claim 2, wherein the cover comprises a pair of handles near each end of the first bar, each of the handles comprising a gripping portion having a pair of free ends passing from the top side of the cover to the bottom side through a pair of the openings in the meshed platform and a stop member on each of the free ends to prevent the handle from slipping back though the openings.

6. The temporary manhole cover of claim 1, wherein the cover comprises a pair of diametrically opposite handles, each of the handles comprising a gripping portion having a pair of free ends passing from the top side of the cover to the bottom side through a pair of the openings in the meshed platform and a stop member on each of the free ends to prevent the handle from slipping back though the openings.

7. The temporary manhole cover of claim 1, wherein the cover is made of metal.

8. A temporary manhole cover comprising:

a. an outer rim dimensioned to be placed over a manhole opening;

b. two parallel and spaced apart rods extending from the outer rim to its center;

c. a valve key receiving and positioning assembly comprising a circular ring and two diametrically opposite sleeves exteriorly attached to the ring for receiving the rods, wherein the assembly is movable along the rods and a valve key can be inserted into the manhole through the ring; and d. a meshed framework covering an area bordered by the rim, except for leaving an area between the two rods, the meshed framework serving as a platform to support a person and defining a plurality of openings that facilitate seeing through the manhole cover for viewing into the manhole after the cover is placed thereon.

9. The temporary manhole cover of claim 8, wherein the outer rim is polygonal.

10. The temporary manhole cover of claim 8, wherein the outer rim is rectangular.

11. The temporary manhole cover of claim 8, wherein the cover comprises a pair of handles, each of the handles comprising a gripping portion having a pair of free ends passing from the top side of the cover to the bottom side through a pair of the openings in the meshed platform and a stop member on each of the free ends to prevent the handle from slipping back though the openings.

12. The temporary manhole cover of claim 8, wherein the cover is made of metal.

* * * * *